US006016633A

United States Patent [19]

Elwart

[11] Patent Number: 6,016,633

[45] Date of Patent: Jan. 25, 2000

[54] CONCRETE BLOCK FORM

[76] Inventor: John Ernest Elwart, P.O. Box 5342, Playa Del Rey, Calif. 90296

[21] Appl. No.: 08/999,276

[22] Filed: Jan. 27, 1997

[51] Int. Cl.[7] ..... B28B 7/22; E04G 11/00

[52] U.S. Cl. ..... 52/294; 52/259; 52/293.2; 249/13; 249/34; 249/190

[58] Field of Search ..... 249/13, 34, 190; 52/251, 259, 293.2, 293.3, 294, 510, 742.14

[56] References Cited

U.S. PATENT DOCUMENTS

| | | | |
|---|---|---|---|
| 1,563,581 | 12/1925 | May | 249/34 X |
| 2,251,775 | 8/1941 | Arrighini | 249/34 |
| 2,289,819 | 7/1942 | Wirtane | 249/34 |
| 2,387,445 | 10/1945 | Herring | 249/34 |
| 2,614,311 | 10/1952 | Shook | 249/34 |
| 2,796,652 | 6/1957 | Walters | 249/13 |
| 2,960,745 | 11/1960 | Wallace | 249/34 X |
| 3,195,852 | 7/1965 | Lundell | 249/34 |
| 3,376,010 | 4/1968 | Myer | 249/34 X |
| 4,635,895 | 1/1987 | Johnson et al. | 249/5 |
| 4,678,156 | 7/1987 | Scalamandre et al. | 249/34 |
| 5,207,931 | 5/1993 | Porter | 249/34 X |
| 5,367,845 | 11/1994 | Hartling | 52/294 X |
| 5,399,050 | 3/1995 | Jacobbus | 405/229 |
| 5,511,761 | 4/1996 | Schultz | 249/34 |
| 5,535,981 | 7/1996 | Goris | 249/157 |
| 5,833,872 | 11/1998 | De Le Fevre | 249/34 |
| 5,882,540 | 3/1999 | Farrington | 249/34 |

*Primary Examiner*—Beth Aubrey
*Assistant Examiner*—Brian E. Glessner

[57] ABSTRACT

A weight supporting device combined to a concrete footing form for assembling and filling concrete blocks and the footing form simultaneously is provided. Two symmetrical sidewalls combined with interlock fasteners provide strength to suspend on the form an entire wall of concrete blocks before and during the filling of the cells of the blocks and the form.

3 Claims, 1 Drawing Sheet

CONCRETE BLOCK FORM

FIELD OF THE INVENTION

This invention relates to concrete footings and concrete blocks and in particular a footing form the size of a footing for a concrete block wall, in which the form has two symmetrical sides that are contoured to support the block wall which will be built on top of the form. The top of the form is a platform connected to the opposing symmetrical walls and the top platform allows blocks to be mounted on its surface, which is guided by sidewalls. The block wall is erected on the top platform, after securing the first row of blocks in place to sidewalls of the platform, and successively each row of blocks can be mounted and an entire wall can be built on the platform.

The platform is supported by a vertical wall cavity, which as a one piece design is an opening the size of the depth of any prospective footing needed for any size concrete block mounted on the upper platform. The blocks rest on top of the form which can support the weight of the wall as well as the concrete to fill the wall, and the concrete will pass through the cells of the blocks and into the lower vertical cavity of the form. As the form fills, supplied with liquid concrete poured into the block cells from the top of the wall, the concrete eventually fills the form and travels up the wall and fills the entire wall of concrete block cells, thereby filling the blocks and the footing form simultaneously.

DESCRIPTION OF THE RELATED ART

In the construction of buildings which utilize concrete blocks instead of wood or solid concrete walls, the traditional method of the building process was the necessary task of soil excavation. Usually more than needed was removed either by expectation or the need to have enough room to install wooden stakes to brace the existing crude wooden forms which are still used on a daily basis to form a footing for a concrete block wall.

By way of example, U.S. Pat. No. 5,511,761 to Schultz discloses a wall forming device for erecting concrete walls.

U.S. Pat. No. 4,678,156 to Scalamandre et al., discloses a reusable concrete form which utilizes pre-spaced tierods to erect walls of concrete.

U.S. Pat. No. 5,399,050 to Jacobbus discloses a plastic concrete form for footers to provide drainage for concrete block walls.

U.S. Pat. No. 3,376,010 to Meyer discloses a forming apparatus to pour wall and footing simultaneously out of liquid concrete.

U.S. Pat. No. 4,635,895 to Johnson Jr. et al., discloses a device that enables the simultaneous pouring of a concrete floor slab with a concrete footing.

U.S. Pat. No. 2,251,775 to Arrighini discloses a device for forming footings and walls simultaneously.

U.S. Pat. No. 5,207,931 to Porter discloses a brace for a concrete form, allowing the footing and a portion of a wall to be formed in one pour.

U.S. Pat. No. 5,367,845 to Hartling discloses a device that casts concrete blocks from a polystyrene form in which the polystyrene is left in the mold as an insulator.

U.S. Pat. No. 1,563,581 to May discloses a fluid concrete wall and footing forming device to be poured simultaneously.

U.S. Pat. No. 5,882,540 to Farrington discloses a wall forming and footing forming system that involves setting concrete around door openings, window areas and the like.

U.S. Pat. No. 2,387,445 to Herring discloses a device that forms footings and walls simultaneously and has a flanged support system on the top of the form to allow cars filled with concrete to dump cement into the form.

While these devices fulfill their objective and requirements, none of the aforementioned patents describe a form which supports a wall of concrete blocks in proper position for the purpose of pouring a concrete footing and filling the hollow inside of the blocks simultaneously.

Respective to Herring, U.S. Pat. No. 2,387,445, is the only patent that supports weight on top of the form. The Herring patent has a flanged support on the top wall form to allow travel of cement loaded trolley cars to ride by and deliver concrete into the form.

The present invention, however is only a footing form, and not a wall forming device. Its support strength which is developed by the shape and design supports the weight of any length and height concrete block wall whereby the first row of blocks are mounted on top of the form at the top footing level where a channel is provided to securely align the blocks. Thereafter, each row of blocks are successively installed with the proper mortar and a wall can be built in the same traditional manner, with the footing unfilled; and when the concrete is pumped into the cells of the concrete blocks, the footing form is filled first and the concrete blocks slowly fill up with concrete until it reaches the top of the wall, thereby filling wall and footing form simultaneously.

In this respect, the concrete block form according to the present invention substantially departs from the conventional concepts and designs of the related art and provides a device that is developed for the specifically isolated purpose to enable a footing for a concrete block wall to be poured simultaneously with the hollow inside of the block for the purpose of eliminating seams and cracks between the footing and the block wall and to produce superior strength from a single concrete pour.

The present invention solves the problem of the need to build a footing form for a concrete block wall and pour the concrete for the footing and wait until the liquid cures to strip the forms and re-level the forms to install the blocks. The present invention solves the moisture leaks possible from the prior art two pour system. In this regard, the present invention substantially fulfills the need for an improved form.

BRIEF SUMMARY OF THE INVENTION

It is the principal object of this invention to provide a symmetrical two sided form which doubles as a concrete block supporting platform to serve as a rigid support base to erect an entire block wall on top of the platform, which has appendaged designed to allow the blocks to be installed on top of the form in a channel which also has side braces. This channel platform allows blocks to be installed and to fit securely on the top of the footing form as easily as a block can rest on a footing made of concrete which is solidified and ready for use.

To accomplish this objective, I have developed a weight supporting platform footing forming apparatus; known hereafter as a concrete block form. This device does two things; the first portion of the symmetrical two piece apparatus in which the device has a left side and a right side and both are identical, is the lower bottom of the form.

The bottom of this apparatus serves as a hollow chamber and is of a predetermined width, to in conjunction with any width size of concrete block, produce a determined inside hollow chamber thickness large enough to be the size of the width of a footing for any respective depth of concrete block.

The upper portion of the form, which is a platform connected to the bottom of the form is determined by its size and shape to allow the concrete blocks to be positioned securely and safely and an entire wall can be built with each row of blocks successively mounted on the lower row of blocks originally mounted on the form and continuously until an entire wall has been erected.

Each block is mounted horizontally on top of the platform which has vertical sidewalls to guide and stabilize its position. After the desired size of block is determined, a perforation provided in the form at the beginning and end length of a full size concrete block is utilized to install a bolt through the grout line, from one side of the upper platform to the other side and a nut is tightened to fasten the concrete block to the upper portion of the form.

Overlapping ends of each section of this form as well as mitered corners solve the problem of the process in preparing an entire wall system for the block setters to do their work. In the event of elevated wall sections, taller footing bottoms can be manufactured and a series of products can be sold as a kit.

In that the prior art has its benefits and disadvantages of the references cited, the prior atr of the present invention has not shown to exist due to the lack of information in each U.S. Patent disclosure understood and read.

None of the references cited disclosures have shown a single invention that supports a concrete block wall. While many of the references have disclosed devices that form walls, and walls, slabs or footings simultaneously, none have shown a device that a wall can be built on which is designed to bear the weight of the wall before, during and after the concrete pour.

Therefore, the present invention solves the problem of the complications in fastening, building, cutting concrete forms made to prepare fluid concrete as a footing in relation to the erection of concrete block walls and the present invention saves time, labor, produces with its use a stronger wall and eliminates seams between the block and the footing and reduces the process of manufacture of a block wall to one cement pour instead of the conventional two.

DETAILED DESCRIPTION OF THE INVENTION

Figure 1:
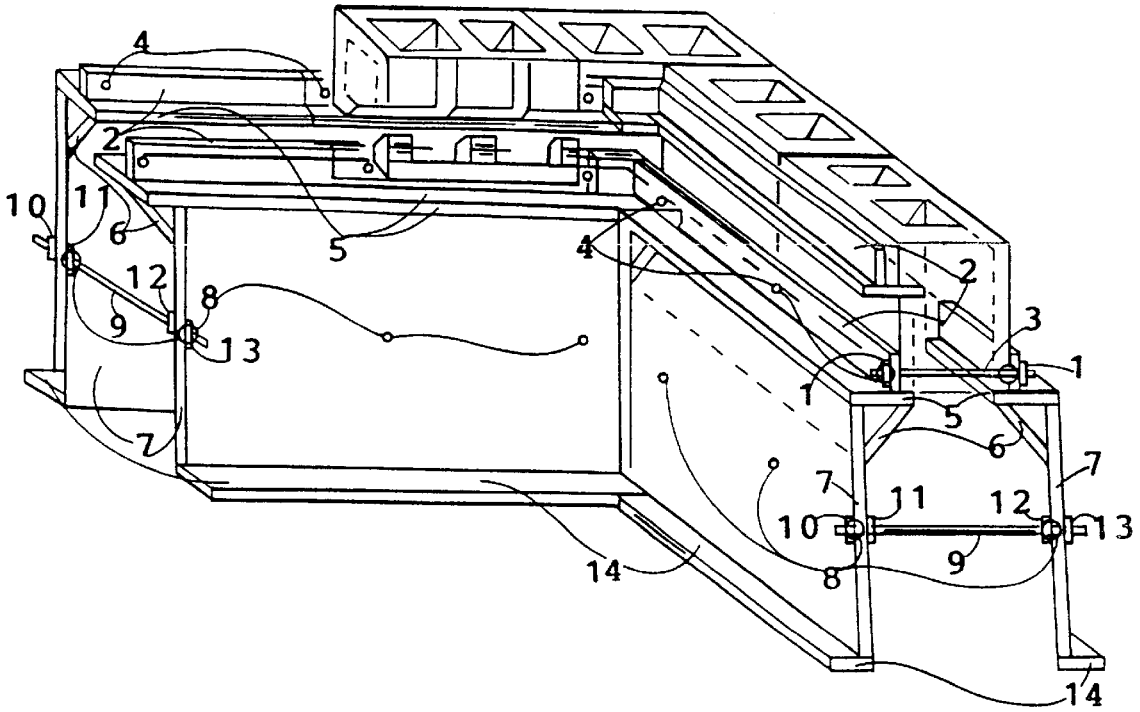
FIG. 1 is a two dimensional view of the concrete block form together with associated fastening bolts and allthread bolt. This drawing shows the complete functional aspect of the present invention which includes the mounting of concrete blocks on the form and the mitered angle of the form to create a corner.

Looking particularly to FIG. 1, each side of a concrete block form includes a vertical sidewall 7, a left and a right, and the height of 7 is a necessary height to produce with its dimension, the depth necessary to facilitate the production of a footing when liquid concrete is poured through the concrete blocks that are mounted on top of the upper form channel 2 and 5.

Each sidewall 7 rests the final weight of the mounted concrete blocks as well as fluid concrete on 14, which is a flat surface that enables the entire form to be leveled before mounting blocks. To enable the proper space relationship between the left and right of 7, an allthread rod 9 is provided and is secured to both the inside and outside of 7 left and 7 right and the width between 7 is measured and all four nuts are tightened.

The determining property in this manner is the depth of the concrete blocks to be stacked on top of the form.

Once the block is stacked on the top platform channel 2 and 5, bolt 3 can be inserted through perforated holes 4 located at the front of the form and at every interval of the beginning and end of a full size concrete block, and secure the blocks to vertical top platform sidewall 2, and tighten 2 to the block by tightening a nut.

When the bolt 3 is tightened, it will produce automatically the lower form footing width for any prospective size concrete block inserted in top platform channel 2 and 5. 3 is secured by nut 1, or if allthread rod is used, nut 1 will be on the left and right of 4.

Horizontal concrete block support 5 as it protrudes out from vertical bolt support 2 is designed to support the wall thickness of the block and does not obstruct the inner cell of the block. The 45 degree diagonal connector 6 enables 5 to function without sagging or collapsing the form due to extreme weight.

Therefore 7 is burdened with extreme weight as the blocks accumulate with each row. To prevent inward or outward movement from bearing weight on sidewall 7, a perforated hole 8 is provided vertically below hole 4 in the center of the lower portion of the form, to receive an allthread bolt through the lower portion and this portion is interlocked with two inner nuts and two outer nuts to prevent movement in any direction.

The lower portion of the form is wider than the top due to a pre-determined 45 degree angle in the upper platform support design that ultimately increases the width of the bottom form to be a width suitable to be the width of a concrete footing for the size blocks stacked on top of the platform channel 2 and 5.

The lower form section is supported both inward and outwardly with an allthread bolt long enough to span the determined width, depending on the size of the block. The allthread bolt uses four nuts, two which are to secure the inside cavity width and two nuts to secure the outside panel to the inside cavity. The outward nuts secure the outside form panel wall and tighten the wall to secure it to the determined position the inward nuts have been adjusted to. Thus, the two outside nuts tighten the wall of the form to the inside nuts and secure a firm dimensional strength. With these nuts in their fastened position, the form is ready to build on and will support the weight of an entire wall of concrete blocks before concrete is poured and during the filling process.

The form has feet on the bottom to enable economic and accurate leveling of the surface prior to block installation. Forms are removed by unscrewing 10, 13 on the bottom and 1 on top. 9 remains in solid concrete, while 3 can be removed by hammering through grout line. The present invention is light enough to use the services of two laborers to carry and assemble this device.

The fastening nuts 10, 11, 12, 13 are each a specific support producing fastener. Nut 10 is the left fastener for 7 and stops weight from moving the form outward. Nut 11 is the right connector to the left side 7 and together with 10, prevents movement in either direction so the form cannot cave in or bow.

However, neither are functional until the right side of 7 are fastened with 12 and 13 which serve to interlock the specified width of the form according to the actual width of the block used.

Therefore 12 is the left nut fastener and serves as an inner width adjuster of both left and right 7 because before 12 can be tightened, it must be measured for accuracy. Once adjusted, the inner width is established, but not until 13 is applied and tightened, or the form can blow out or collapse due to instability. Nut 13 therefore, completes the assembly of the form proper to receive blocks and concrete weight as nut 13 locks in the last final right side of 7 to nut 12 and the form is complete.

The present invention eases the labor required to build a block wall and pour a footing by combining the fill procedure for both concrete block cells and footing at the same time. The described invention is a weight supporting platform footing forming apparatus, that is a footing form and a weight supporting device, which are combined in one function to produce what is claimed:

I claim:

1. A weight supporting platform footing forming apparatus for the foundation of a concrete block wall, wherein the apparatus comprises:

first and second symmetrically opposing sides situated a determined spaced apart distance and forming an inner cavity, said determined spaced apart distance is adapted to accomodate any size concrete blocks;

said first and second sides of said apparatus further comprising horizontal base portions, with inner edges, for level placement on a ground surface, first and second vertical stepped up walls connected to the inner edges of the base portions, a means, by a projecting angle, for increasing the determined spaced apart distance of the first and second vertical stepped up walls and base portions to produce a required width of a concrete footing for said any size concrete blocks, the means for increasing the determined spaced apart distance comprises a pair of 45 degree angular walls connected to an upper, inner surface, opposite the base portions, of each said first and second vertical stepped up walls, a supporting platform adapted to support said any size concrete blocks, wherein the supporting platform comprises first and second horizontal walls inwardly disposed and attached to ends, opposite the base portions, of the first and second vertical stepped up walls and above the pair of 45 degree angular walls;

and means to align said any size concrete blocks, wherein said means to align comprises first and second vertical walls upwardly disposed, recessed inwardly from an inner end of said first and second horizontal walls, and connected to said first and second horizontal walls.

2. The apparatus according to claim 1, wherein said first and second vertical stepped up walls and said first and second vertical walls further comprise a plurality of perforations that are located in the center of each said walls, said plurality of perforations in said first stepped up wall and said first vertical wall are arranged symmetrically with the plurality of perforations in the second vertical stepped up wall and the second vertical wall, the plurality of perforations are to be spaced apart in intervals corresponding to a length of said any size concrete block.

3. The apparatus according to claim 1, wherein said apparatus has precise dimensions for supporting a wall of concrete blocks on the supporting platform, wherein the supporting platform is connected to the pair of 45 degree angular walls and the first and second stepped up vertical walls, in which the first and second vertically stepped up walls are finally connected to the horizontal base portions;

said precise dimensions further ensure a proper width of the inner cavity and supporting platform, wherein the inner cavity is capable of forming a footing, and the supporting platform is adapted to hold concrete blocks having hollow cores and arranged to form a wall above the inner cavity, the apparatus is further adapted to permit the filling of the hollow cores of the concrete blocks and the inner cavity with concrete simultaneously, therefore eliminating the need to pour the footing and hollow cores separately, the apparatus is constructed so as to be capable of supporting a weight of the concrete block wall and concrete until said concrete hardens.

* * * * *